United States Patent [19]

Feder

[11] 4,100,993

[45] Jul. 18, 1978

[54] ACOUSTIC LINER

[75] Inventor: Ernest Feder, West Hartford, Conn.

[73] Assignee: United Technologies Corporation, Hartford, Conn.

[21] Appl. No.: 677,335

[22] Filed: Apr. 15, 1976

[51] Int. Cl.[2] ..... F01N 1/02

[52] U.S. Cl. ..... 181/213

[58] Field of Search ..... 181/33 C, 33 D, 33 H, 181/33 HA, 33 L, 42, 48-213-214, 224, 232, 247-250, 276, 284, 286, 292-293

[56] References Cited

U.S. PATENT DOCUMENTS

| | | | |
|---|---|---|---|
| 2,765,044 | 10/1956 | Hatte | 181/48 X |
| 3,819,007 | 6/1974 | Wirt et al. | 181/33 D X |
| 3,819,009 | 6/1974 | Motsinger | 181/33 H X |
| 3,820,628 | 6/1974 | Hanson | 181/33 HA X |

FOREIGN PATENT DOCUMENTS

| | | | |
|---|---|---|---|
| 131,432 | 4/1951 | Sweden | 181/48 |

*Primary Examiner*—Lawrence R. Franklin
*Attorney, Agent, or Firm*—Norman Friedland

[57] ABSTRACT

The acoustic treatment for low frequency noise reduction is improved upon in a deep backing cavity lining configuration by providing a depending member or lip at the entrance extending into the cavity defining a space for supporting a column of air for increasing the mass reactance with a resulting decrease in the cavity depth without sacrificing sound attenuation. A slotted construction provides the smallest width of surface opening in the direction of air flow minimizing aerodynamic losses.

5 Claims, 6 Drawing Figures

FIG. 4
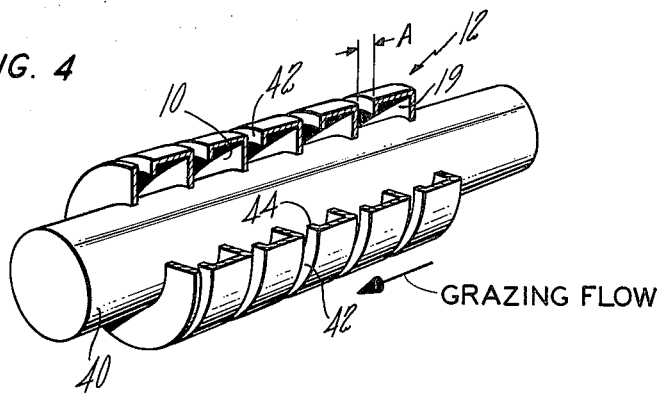
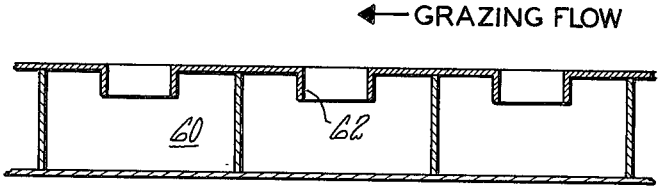
FIG. 6
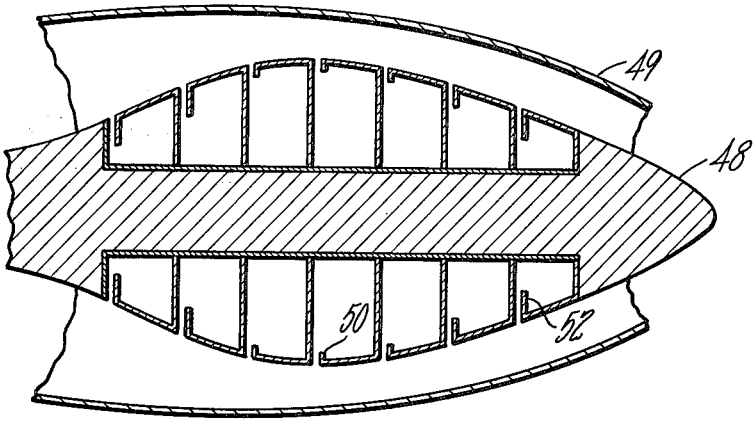
FIG. 5

ACOUSTIC LINER

BACKGROUND OF THE INVENTION

This invention relates to sound absorbing liners and particularly to the deep backing cavity liner configurations for jet engine applications.

As is well know in the acoustic art, the liner must be tuned to the frequency of the noise which is intended to be attenuated. In a turbofan engine, a dominant noise in the primary flow is that produced by the combustor which falls within a relatively low frequency range, say below 1000 Hz. It is well known that in a deep back cavity liner the depth of the cavity is directly related to the frequency in that as the cavity depth is increased the frequency of maximum noise attenuation decreases.

The problem, thus, is obvious where there is a space limitation, the depth available may not accommodate a deep enough cavity and thus prohibit the atenuation at the necessary low frequency range. Thus, a 6 inch depth backing cavity is not possible if less than 6 inch are available. Another well known technique for decreasing resonant frequencies is used in a simple Helmholtz reasonator. The neck depth is increased which increases the effective mass reactance which decreases the natural frequency of the resonator. A similar technique can be applied to the engine acoustic treatment which consits of increasing the thickness of the facing to sheet. This again has its limitations since additional weight of the facing sheet is a severe penalty on engine performance, which may be intolerable, in addition to the space limitation noted above.

I have found that I can obviate the problems noted above by providing on the facing sheet a depending lip at the entrance slot extending into the cavity for providing space defining means for supporting a column of air. This increases the mass reactance, lowers the tuning frequency and permits the design to give substantially the same sound attenuation that would otherwise be obtained attendant an increase of the depth of the cavity. Furthermore, by making the acoustic treatment a slotted construction, the smallest opening on the surface of the acoustic treatment in the direction of air flow is provided. Aerodynamic losses due to back flow and turbulence increase as the opening increases. Therefore, the proposed construction provides the minimum aerodynamic loss for a required acoustic treatment design.

In another embodiment the column shape is modified so as to increase the mass reactance without increasing the depth of the column.

This invention also contemplates controlling the dimensions of the entrance slot and the depth of the entrance column to maximize acoustic treatment in a non-uniform element where the cavity depth is inherently limited as would be the case of a plug of the tailpipe of an engine.

SUMMARY OF THE INVENTION

An object of this invention is to provide improved acoustic sound absorber linings.

A still further object of this invention is to provide improved sound absorbing liners for low frequency attenuation which includes a deep back cavity by including depending members defining an air column at the cavity entrance for increasing mass reactance. The slotted construction provides minimum aerodynamic loss.

A still further object of this invention is to provide an improved acoustic liner by designing the entrance to a deep backed cavity to support a column of air and control the parameters that tune each cavity individually to compensate for different depths for adjacent cavities.

Other features and advantages will be apparent from the specification and claims and from the accompanying drawings which illustrate an embodiment of the invention.

BRIEF DESCRIPTION OF THE DRAWINGS

FIG. 4 is a perspective view, partly in section illustrating another embodiment of this invention.

FIG. 5 is a sectional view illustrating another embodiment of this invention.

FIG. 6 is a sectional view illustrating alternate construction of this invention.

DESCRIPTION OF THE PREFERRED EMBODIMENT

Figure 1:
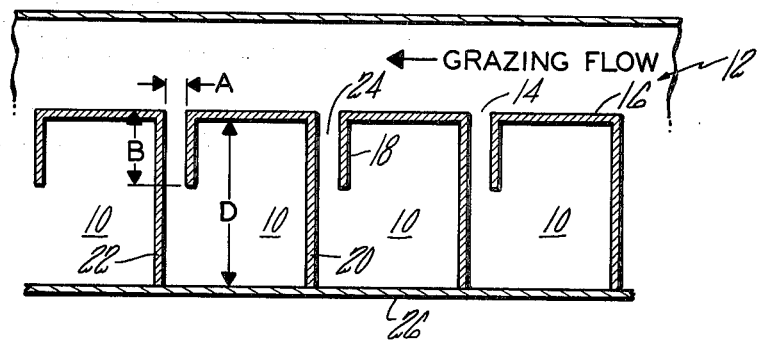
FIG. 1 is a partial sectional view illustrating the invention.

Referring to FIG. 1, the invention can best be understood by appreciating that the deep back cavity 10 for liner 12 forms an acoustic suppression chamber and communicates with entrance slot 14. Generally, liner 12 forms the inner surface of the air passage. Heretofore, the deep backing cavity included apertures or slots or a porous facing sheet. The grazing flow passes over the facing sheet of liner 12 in the direction indicated by the arrow and the sound waves carried thereby are suppressed in a well known manner.

Heretofore, as mentioned above, the depth (indicated by D) of cavity 10 would be conventionally sized (tuned) to accommodate the frequency of the sound waves intended to be suppressed. According to this invention, this depth is shortened for a given frequency by including depending lip 18 which together with the side wall 20 of the adjacent side plate 22 define space 24 providing an air colum. The distance between lip 18 and back side 20 represented by reference letter A and the depth of the air column represented by reference letter B are parameters that control the mass reactance and, together with the size of the cavity (for a given material), determine the sound suppressing characteristics of the liner. As noted, the width of slot A is only limited to the dimension where it supports a column of air. Beyond this point the column breaks down. The effective mass reactance is controlled by dimensions A and B.

Figure 2:
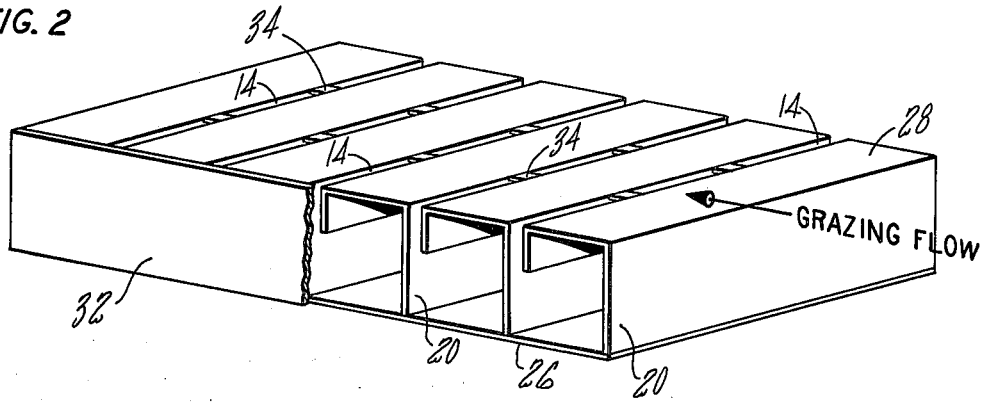
FIG. 2 is a partial perspective view showing a lining configuration.

A panel designed in the configuration illustrated in FIG. 1 is shown in FIG. 2. Similar reference numerals designate equivalent elements. Each cavity or open ended channel 10 are defined by backing sheet 26, side walls 20 and the facing sheet 28. The L-shaped member made-up of facing sheet 28 and side walls 20 may be made integral or may be formed as separate panels suitably joined at the mating edges. An end plate 32 blocks off the end of the cavity 10 and a similar end plate (not shown) is similarly mounted on the opposite end. Spacers 34 may be employed to add rigidity to the overall structure.

Figure 3:
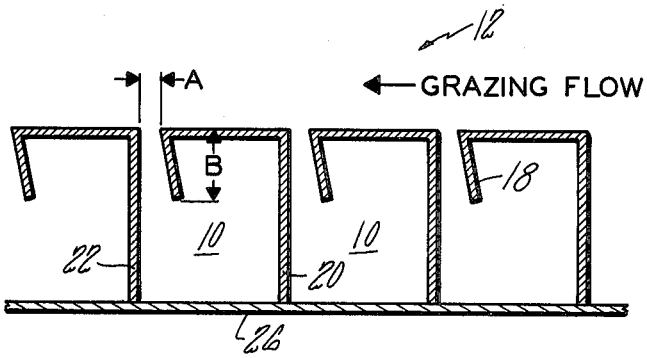
FIG. 3 is a partial sectional view illustrating a modification to the preferred embodiment.

FIG. 3 shows another configuration where lip 18 is angled with respect to the side panel 22 (like parts are designated with the same reference numerals and letters as in the other FIGS.). As noted the volume of the air column for a given slot width (A) is increased hence increasing the mass reactance.

FIG. 4 shows a liner configuration wrapped around the core engine of a turbine type power plant. The cylinder 40 represents the core engine. Each L-shaped (in cross section) element is formed into an annular disc surrounding the core engine and are spaced relative to the adjacent element to define the cavities 19. The annular slot 42 forms the entrance and annular lip 44 extends into the cavity and is spaced from the adjacent annular disc to form the air column.

FIG. 5 exemplifies still another embodiment where the liner is used in an irregular shaped element, as for example, in plug 48 located in the tailpipe 49 of a jet engine. As noted, since the diameter of the plug 48 along different stations vary, in order to compensate for the different cavity depths the other parameters, namely lip length and slot spacing are varied to get equivalent tuning. Hence at the largest diameter, namely, the plug center station the lip 50 is shorter than lip 52 at a reduced diameter station.

FIG. 6 exemplifies another configuration where the entrance to cavity 60 may take any other shape other than a slot as was illustrated above. In this instance the depending lip 62 which may be cyclindrical, rectangular, square or the like extends into cavity 60 defining an air column, thus measuring the mass reactance, as described above.

It should be understood that the invention is not limited to the particular embodiments shown and described herein, but that various changes and modifications may be made without departing from the spirit or scope of this novel concept as defined by the following claims.

I claim:

1. An acoustic low frequency sound suppressor liner comprising a backing sheet, a plurality of elongated flat surface members parallelly spaced to said backing sheet defining a facing sheet exposed to the grazing flow of a substantial velocity and sound pressure and upstanding spaced side wall members extending therebetween defining a plurality of sound suppressing cavities, lip means spaced from one of said wall members extending from one edge of each of said flat surface members extending into each of said cavities to define with said one of said wall members a volume chamber supporting a column of air communicating internally of each of said cavities, the width and depth of said volume chamber establishing the mass reactance whereby the depth of each of said cavities is sized for a given sound attenuation by selecting said mass reactance for a predetermined frequency intended to be attenuated, said volume chamber extending in a lateral direction with respect to said grazing flow, each of said upstanding side wall members form a common wall for adjacent cavities and said lip means is angularly spaced with respect to the adjacent upstanding wall and is in a volume increasing direction from the entrance to the exit which together defines the volume chamber.

2. An acoustic low frequency sound suppressor liner mounted in a duct and exposed to grazing flow of fluid having substantially high velocity and high sound pressures, said liner comprising:

a backing sheet;

a plurality of elongated flat surface members parallely spaced to said backing sheet defining a facing sheet exposed to said grazing flow;

an upstanding, spaced side wall member extending from said backing sheet to one elongated edge of each of said surface members to define a plurality of sound suppressing cavities, said each side wall member forming a common wall between adjacent cavities; and lip means extending from the other elongated edge of each of said surface members into each of said cavities, said lip means being spaced from one of said wall members to define therewith a volume chamber having a first slot communicating with said grazing flow and a second slot communicating with each of said cavities, the width and depth of said volume chamber cooperating with the volume of the associated cavity to determine the resonant frequency of sound attenuated thereby, said slots extending laterally with respect to said grazing flow.

3. An acoustic liner as in claim 2 wherein the lip extends coextensively with said first slot.

4. An acoustic liner as in claim 2 wherein each of said cavities may have a different depth to accommodate an irregularly shape object; and said volume chamber having parameters of depth and width selected to tune each of said cavities to the same resonant frequency.

5. An acoustic liner as in claim 2, further comprising an end plate blocking off each end of said plurality of cavities and at least one spacer connecting said other elongated edge to said one wall member to add rigidity to the overal structure.

* * * * *